US006279556B1

(12) United States Patent
Busen et al.

(10) Patent No.: US 6,279,556 B1
(45) Date of Patent: Aug. 28, 2001

(54) OIL SEPARATOR FOR REMOVING OIL FROM THE CRANKCASE VENTILATION GASES OF AN INTERNAL COMBUSTION ENGINE

(75) Inventors: Jürgen Busen, Ahaus; Sieghard Pietschner, Greven, both of (DE)

(73) Assignee: Walter Hengst GmbH & Co., KG, Muenster (DE)

( * ) Notice: Subject to any disclaimer, the term of this patent is extended or adjusted under 35 U.S.C. 154(b) by 0 days.

(21) Appl. No.: 09/700,852

(22) PCT Filed: Mar. 14, 2000

(86) PCT No.: PCT/EP00/02230

§ 371 Date: Jan. 11, 2001

§ 102(e) Date: Jan. 11, 2001

(87) PCT Pub. No.: WO00/57038

PCT Pub. Date: Sep. 28, 2000

(30) Foreign Application Priority Data

Mar. 18, 1999 (DE) ..... 199 12 271

(51) Int. Cl.[7] ..... F01M 13/04

(52) U.S. Cl. ..... 123/572; 123/573

(58) Field of Search ..... 123/572, 573, 123/574, 41.86

(56) References Cited

U.S. PATENT DOCUMENTS

| | | | | |
|---|---|---|---|---|
| 5,239,972 | * | 8/1993 | Takeyama et al. | 123/573 |
| 5,460,147 | * | 10/1995 | Bohl | 123/572 |
| 5,944,001 | * | 8/1999 | Hutchins | 123/572 |
| 6,089,213 | * | 7/2000 | Laudien et al. | 123/572 |

* cited by examiner

*Primary Examiner*—Marguerite McMahon
(74) *Attorney, Agent, or Firm*—Sonnenschein Nath & Rosenthal

(57) ABSTRACT

The invention relates to an oil separator (1) for de-oiling crankcase ventilation gases of an internal combustion engine with the oil separator (1) comprising a cyclone encompassing a gas inlet connected to the crankcase of the internal combustion engine, a gas outlet connected to the suction passage of the internal combustion engine, and an oil outlet connected to a crankcase sump of the internal combustion engine. The novel oil separator is characterized in that instead of a single cyclone several smaller cyclones (11, 12, 13, 14) are provided arranged in parallel with each other.

21 Claims, 1 Drawing Sheet

OIL SEPARATOR FOR REMOVING OIL FROM THE CRANKCASE VENTILATION GASES OF AN INTERNAL COMBUSTION ENGINE

BACKGROUND OF THE INVENTION

The present invention relates to an oil separator for de-oiling crankcase ventilation gases of an internal combustion engine with the oil separator comprising a cyclone encompassing a gas inlet connected to the crankcase of the internal combustion engine, a gas outlet connected to the suction passage of the internal combustion engine, and an oil outlet connected to a crankcase sump of the internal combustion engine.

An oil separator of the kind mentioned above is known from DE 42 14 324 C2. In this oil separator a single cyclone is used which is dimensioned such that it may cope with the maximal amount of ventilation gases. An essential feature of this known oil separator is that a downward duct is connected to the oil outlet of the cyclone with the mouth thereof arranged below the oil level of the crankcase sump of the associated internal combustion engine, that a float valve which is normally open and arranged in a lower casing section at the side of the cyclone prevents a backwards flow out of the crankcase sump of the internal combustion engine, and that the complete oil separator as a construction unit is detachably connected to the downward pipe. These specific features of the oil separator have to take care that when the operating conditions of the associated internal combustion engine will certainly and strongly change, e.g., when full speed is achieved following an idle run, no oil from the crankcase sump of the internal combustion engine is transported into the interior of the cyclone because extremely large pressure differences will result from the change of the operating conditions.

The problem mentioned which is dealt with in the above document is solved by the oil separator described therein, however, this oil separator with the single cyclone has the disadvantage that no optimal oil separation is attained across the total range of operating conditions of the internal combustion engine which occur in practical operation. The occurring different operating conditions of the internal combustion engine on the one hand lead to different flow rates of ventilation gases out of the crankcase, and on the other hand to a different oil load of these ventilation gases. As a cyclone will operate only in a definite relative small range of operation conditions of the internal combustion engine, non-required oil volumes will occur in the gases out of the cyclone and fed to the suction air of the internal combustion engines during operation conditions outside of this optimal operating range.

Therefore it is the object of the present invention to provide a generic oil separator avoiding the mentioned disadvantages and ensuring an optimal, i.e., complete or almost complete separation of oil from the crankcase ventilation gases in particular across a very large range of practical operation conditions of the internal combustion engine.

SUMMARY OF THE INVENTION

The object is attained by a generic oil separator which is characterized in that instead of a single cyclone, several smaller cyclones are provided arranged in parallel with each other.

In comparison with an oil separator with a single cyclone, a considerably larger optimal working range of the oil separator is attained with the oil separator according to the invention. In particular the oil separator has a significantly better oil separation in small flow rates of the crankcase ventilation gases, and a smaller sensitivity to variation of this flow rate. In this way, with the oil separator according to the invention, a significantly reduced dependence of the separation rate will result, and therefore of the efficiency on the current operating conditions of the associated internal combustion engine is attained which reduces the oil load of the suction air of the internal combustion engine, which will reduce the oil loss of the internal combustion engine through the crankcase ventilation.

Preferably it is provided that the cyclones are designed with a tangential flow against them. This tangential flow enables in particular a very compact construction which in comparison with an axial flow will keep the construction height of the cyclones low.

A further embodiment of the invention provides that the bodies of the single cyclones comprise middle axes in parallel with each other and are combined to form a cyclone body member. As each cyclone has only to cope with a fraction of the crankcase ventilation gases which corresponds to the number of the cyclones, each cyclone may be designed with a smaller diameter which makes it smaller in total, and even more important, with a reduced height. Thereby the total dimension of the oil separator is advantageously compact, wherein in comparison with a known oil separator, the diameter is slightly larger, however, the height is considerably smaller. This offers an essential relief when accommodating the oil separator in an engine compartment, i.e., of a motor car where frequently jammed conditions occur.

Furthermore it is provided that the feeding passages leading to the corresponding gas inlets of the individual cyclones are formed of a single main feeding passage which is split or divided. Hereby advantageously it is attained that only a single connection line has to be designed from the crankcase to the oil separator in order to guide the crankcase ventilation gases to the oil separator. Only in the separator the gas flow of the ventilation gases is divided into partial flows for the individual cyclones. This simplifies the mounting of the oil separator and keeps the number of connection lines low although several cyclones are in use.

In order to attain a low-cost manufacturing of the oil separator, the main feeding passage and the individual feeding passages are combined to form a feeding passage member.

A further step for reducing the single parts of the oil separator is in that the cyclone body member and the feeding passages member are combined to form a main member.

As mentioned above, the individual cyclones of the oil separator may be designed as a bundle in a compact construction member. As an alternative the design of the oil separator of several individual cyclones offers the advantageous possibility that the individual cyclones may be arranged in and/or at the internal combustion engine in a decentralized manner. In this way there is the possibility to arrange the single cyclones separated from each other at those spots in or at the internal combustion engine where there is space present for a single cyclone. In this way, frequently non-used spaces which have not been used before may be used for one cyclone which as such is relatively small.

As a supplement, the single cyclones may be at least partially be integrated in one or more other components of the internal combustion engine. By this method the effort for manufacturing and mounting the single components of the oil separator and/or the feeding and exhaust lines thereof may be reduced. Additionally, the space for mounting the single components of the oil separator and the feeding and exhaust lines may further be reduced.

The components of the internal combustion engine, namely the cylinder head hood or the air filter housing, are particularly suitable for the integration of the individual cyclones and/or the associated feeding and exhaust lines or parts thereof. The quoted components on the one hand offer free space or space which has not been previously used, in which the cyclones and other parts of the oil separator may be arranged without requiring further space. In addition, these components as such are arranged adjacent to or in the flow path which the crankcase ventilation gases and the oil separated therefrom and the clean gas have to pass.

In order to manufacture the oil separator in a low cost and labor saving fashion, the components thereof are preferably die casting parts of light metal and/or injection molding parts of plastic material.

BRIEF DESCRIPTION OF THE DRAWINGS

Subsequently an example of the invention is explained referring to a drawing. The figures of the drawing illustrate.

DETAILED DESCRIPTION OF THE PREFERRED EMBODIMENT

Figure 1:
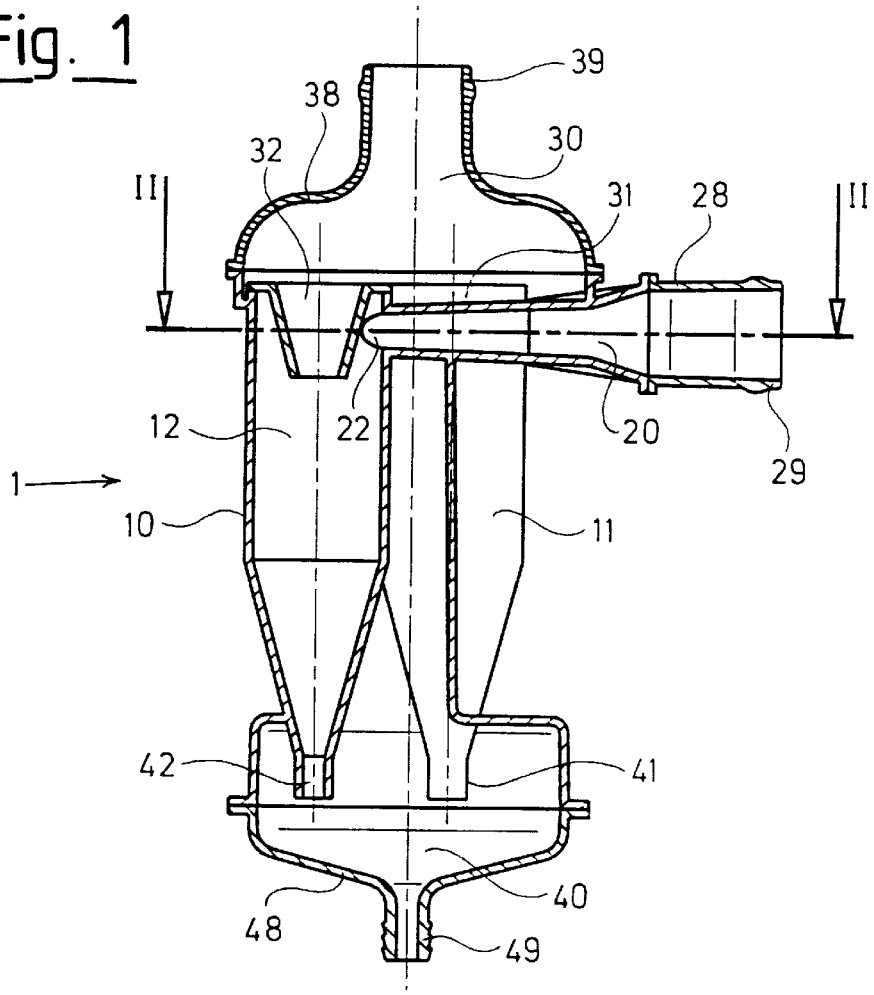
FIG. 1 is an oil separator in a vertical section.

In order to attain a low-cost manufacturing of the oil separator the main feeding passage and the individual feeding passages are combined to form a feeding passage member.

A further step for reducing the single parts of the oil separator consists in that the cyclone body member and the feeding passages member are combined to form a main member.

As mentioned above the individual cyclones of the oil separator may be designed as a bundle in a compact construction member, as an alternative the design of the oil separator of several individual cyclones offers the advantageous possibility that the individual cyclones may be arranged in and/or at the internal combustion engine in a decentralized manner. In this way there is the possibility to arrange the single cyclones separated from each other at those spots in or at the internal combustion engine where there is space present for a single cyclone. In this way frequently non-used spaces which have not been used before may be used for one cyclone which as such is relatively small.

As a supplement the single cyclones may be at least partially be integrated in one or more other components of the internal combustion engine. By this method the effort for manufacturing and mounting the single components of the oil separator and/or the feeding and exhaust lines thereof may be reduced. Additionally the space for mounting the single components of the oil separator and the feeding and exhaust lines may further be reduced.

The components of the internal combustion engine namely the cylinder head hood or the air filter housing are particularly suitable for the integration of the individual cyclones and/or the associated feeding and exhaust lines or parts thereof. The quoted components on the one hand offer free space or space which has not been used thereto, in which the cyclones and other parts of the oil separator may be arranged without requiring further space. In addition these components as such are arranged adjacent to or in the flow path which the crankcase ventilation gases and the oil separated thereof and the clean gas have to pass.

In order to manufacture the oil separator in a low cost and labor saving fashion the components thereof are preferably die casting parts of light metal and/or injection molding parts of plastic material.

Subsequently an example of the invention is explained referring to a drawing. The figures of the drawing illustrate:

FIG. 1 is an oil separator in a vertical section.

Figure 2:
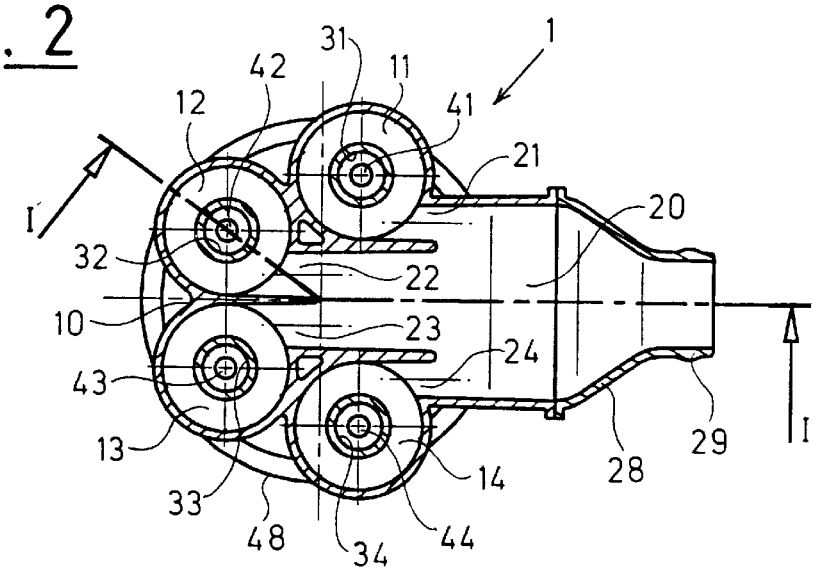
FIG. 2 is the oil separator in FIG. 1 of a horizontal section taken generally along to the line II—II in FIG. 1.

FIG. 2 is the oil separator in FIG. 1 in a horizontal section according to the line II—II in FIG. 1.

The two figures of the drawing illustrate an embodiment for an oil separator 1 comprising four cyclones, 11, 12, 13 and 14. The cyclones 11–14 are combined to form an integrated compact main member 10.

In the vertical section through the oil separator according to FIG. 1 the cyclone 11 is visible in a plane view, and the cyclone 12 is visible in a vertical section wherein the associated section line I—I according to FIG. 2 is drawn in an angle. The cyclones 13 and 14 are not visible in FIG. 1 because they are disposed in front of the section plane.

In the right upper comer in FIG. 1 a main feeding passage 20 is visible which outer i.e., right end is formed as a transfusion member 28 with a line connection piece 29 which has a circular cross section. As seen from right to left which is the flow direction of a ventilation gas guided through the oil separator 1 the feeding passage 20 becomes flatter and (not visible in FIG. 1) at the same time wider whereby the section plane thereof is essentially constant. The feeding passage 20 is divided into four single feeding passages or gas inlets 21–24 whereof in FIG. 1 only the passage or inlet 22 to the second cyclone 12 is visible. In this fashion the arriving gas flow is divided to the four cyclones 11–14 each of which are tangentially streamed against. By this tangential flow the gas flow is turned into a vortex flow which takes care that the carried oil droplets will precipitate at the inner surface of the cyclones 11–14, and will flow downwards. The gas flow being cleaned from the oil droplets will discharge upwards from each cyclone 11–14 through an associated gas outlet 31–34 and will get into a line connection piece 39 through a collector hood 38. To this connection piece 39 a gas line may be connected leading to an air suction passage of an associated internal combustion engine.

The oil separated in the cyclones 11–14 will flow downwards within the cyclones 11–14 and will discharge at the lower end thereof into a collection hopper 48 through individual oil outlets 41–44. In the center of the collection hopper 48 at the deepest part thereof a line collection piece 49 is provided to which an oil return line may be connected leading to the crankcase sump of the associated internal combustion engine.

In the section illustrated in FIG. 2 through the oil separator 1 in particular the room saving and compact arrangement of the four cyclones 11–14 is visible. At the uppermost right side of the line connection piece 29 is visible to which a line is to be connected coming from the crankcase of the associated internal combustion engine, through which line the crankcase ventilation gas loaded with oil droplets and coming from the crankcase is guided to the oil separator 1. Further to the left side it is illustrated that the main feeding passage 20 is enlarged in the area of the transition piece 28 and as described referring to FIG. 1 at the same time becomes flatter. Still further to the left side of the main feeding passage is divided in four feeding passages or gas inlets 21–24 each of which is associated with the cyclones 11–14. Each feeding passage or gas inlet 21–24 is made tangential in relation to the associated cyclone 11–14. In the two cyclones 11 and 12 the flow path is such that a gas flow rotating towards the right side will result, whereas in the cyclones 13 and 14 the gas flow will have a left side rotation. In the interior of each cyclone 11–14 the viewer will look through the associated gas outlet 31–34 to the oil outlet 41–44 arranged at the downiest part of the cyclones 11–14. At the lowest part in the background of FIG. 2 a small part of the collection hopper 48 for the separated oil is visible.

In particular in FIG. 2 is illustrated that the arriving gas flow is divided to the four individual cyclones 11–14 without deviation and therefore without increase of the flow resistance. By this division of the gas flow to several cyclones an increased oil separation will result in particular with smaller volumes of ventilation gases, at the same time reducing the sensitivity against variations of the flow rate of the crankcase ventilation gas.

As it is illustrated in the embodiment of the oil separator 1 the oil separator may be manufactured of only a few single components, in the present example of a main member 10, the transition part 28, the gas outlets 31–34 combined to one unit, the collection hood 38, and the collection hopper 48. In addition there are associated connection lines which preferably may be designed as hoses as it is known as such. As an alternative single or all connection lines at least partly may be integrated into further components of the internal combustion engine which will reduce the manufacturing and mounting effort of individual lines or make it redundant as such. The nominated parts of the oil separator 1 preferably are die casting parts of light metal or injection molding parts of plastic material wherein plastic material is to be selected which can withstand the occurring thermical and chemical stresses.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. An oil separator for de-oiling crankcase ventilation gases in an internal combustion engine, said oil separator comprising a plurality of cyclones, each communicating with a gas inlet for connection to a crankcase of an internal combustion engine and with a gas outlet for connection to a suction passage of the internal combustion engine, and each having an oil outlet for connection to a crankcase sump of the internal combustion engine, wherein said cyclones are arranged such that a gas flow therethrough occurs in parallel through said plurality of cyclones.

2. An oil separator according to claim 1, wherein the cyclones are designed to receive a gas flow from said gas inlet in a tangential flow thereinto.

3. An oil separator according to claim 1, wherein each of said cyclones is formed of a body and said bodies comprise central axes arranged in parallel with each other.

4. An oil separator according to claim 3, wherein said bodies are combined to form a single cyclone body member.

5. An oil separator according to claim 3, wherein each of said cyclones is provided with a gas inlet which communicates with a main feeding passage which is formed as a single main feeding passage which is split into individual feeding passages to communicate with each of said gas inlets.

6. An oil separator according to claim 5, wherein the main feeding passage and the individual feeding passages are combined to form a feeding passage member.

7. An oil separator according to claim 6, wherein the cyclone body member and the feeding passages member are combined to form a main member.

8. An oil separator according to claim 1, wherein the single cyclones are arranged in a decentralized manner relative to the internal combustion engine.

9. An oil separator according to claim 8, wherein the single cyclones at least partially are integrated in one or more other components of the internal combustion engine.

10. An oil separator according to claim 9, wherein said one or more other components of the internal combustion engine comprises one of a cylinder head hood and air filter casing thereof.

11. An oil separator according to claim 1, wherein the single parts thereof are die casting parts of light metal and/or injection molding parts of plastic material.

12. An oil separator for de-oiling crankcase ventilation gases in an internal combustion engine, said oil separator comprising a plurality of clones, each cyclone having a tangential gas inlet, a gas outlet, and an oil outlet at a lower end thereof, wherein a flow of ventilation gases through said oil separator occurs in parallel through said plurality of cyclones.

13. An oil separator according to claim 12, wherein each of said cyclones is formed of a body and said bodies comprise central axes arranged in parallel with each other.

14. An oil separator according to claim 13, wherein said bodies are combined to form a single cyclone body member.

15. An oil separator according to claim 13, wherein each of said cyclones is provided with a gas inlet which communicates with a main feeding passage which is formed as a single main feeding passage which is split into individual feeding passages to communicate with each of said gas inlets.

16. An oil separator according to claim 15, wherein the main feeding passage and the individual feeding passages are combined to form a feeding passage member.

17. An oil separator according to claim 16, wherein the cyclone body member and the feeding passages member are combined to form a main member.

18. An oil separator according to claim 12, wherein the single cyclones are arranged in a decentralized manner relative to the internal combustion engine.

19. An oil separator according to claim 18, wherein the single cyclones at least partially are integrated in one or more other components of the internal combustion engine.

20. An oil separator according to claim 19, wherein said one or more other components of the internal combustion engine comprises one of a cylinder head hood and air filter casing thereof.

21. An oil separator according to claim 12, wherein the single parts thereof are die casting parts of light metal and/or injection molding parts of plastic material.

* * * * *